US005958085A

United States Patent [19]

Eggers et al.

[11] Patent Number: 5,958,085

[45] Date of Patent: Sep. 28, 1999

[54] PROCESS FOR DYEING A TEXTILE SUBSTRATE IN AT LEAST ONE SUPERCRITICAL FLUID

[75] Inventors: Rudolf Eggers, Buxtehude; Joachim von Schnitzler, Hamburg; Richard Huber, Beilstein; Gottlob Wörner, Bönnigheim, all of Germany

[73] Assignee: Amann & Sohne GmbH & Co., Bonnigheim, Germany

[21] Appl. No.: 08/981,198

[22] PCT Filed: Aug. 5, 1996

[86] PCT No.: PCT/DE96/01456

§ 371 Date: Mar. 11, 1998

§ 102(e) Date: Mar. 11, 1998

[87] PCT Pub. No.: WO97/14843

PCT Pub. Date: Apr. 24, 1997

[30] Foreign Application Priority Data

Oct. 17, 1995 [DE] Germany ..... 195 40 227

[51] Int. Cl.[6] ..... D06P 3/54; D06P 5/20

[52] U.S. Cl. ..... 8/475; 8/922; 8/149.2; 8/155; 8/611

[58] Field of Search ..... 8/475, 155, 149.2, 8/611

[56] References Cited

U.S. PATENT DOCUMENTS 5,199,956 4/1993 Schlenker et al. ..... 8/473

5,269,815 12/1993 Schlenker et al. .

FOREIGN PATENT DOCUMENTS

| | | |
|---|---|---|
| 0514337 | 11/1992 | European Pat. Off. . |
| 3906724 | 9/1990 | Germany . |
| 4237823 | 4/1994 | Germany . |
| 4238621 | 5/1994 | Germany . |
| 4238622 | 5/1994 | Germany . |
| WO 93/14259 | 7/1993 | WIPO . |
| WO 94/18264 | 8/1994 | WIPO . |

OTHER PUBLICATIONS

"Application of Supercritical Carbon Dioxide in Finishing Process," D. Knittel, W. Saus, E. Schollmeyer, *Journal of the Textile Institute*, (No month 1993) No. 4, pp. 534–552.

"Activité ennoblissment," *L'Industrie Textile*, No. 1233, p. 58 (Jun. 1992).

*Primary Examiner*—Margaret Einsmann

*Attorney, Agent, or Firm*—Proskauer Rose LLP

[57] ABSTRACT

The description relates to a process for dyeing a textile substrate in at least one supercritical fluid, preferably for dyeing spools of yarn in supercritical carbon dioxide, where the textile substrate is placed in an autoclave in which the supercritical fluid containing at least one dye is caused to flow over or in it. The at least one dye is brought into contact with the supercritical fluid in loose, molten, solution and/or dispersion form to produce a stable solution of the dye in said fluid, avoiding the originally dissolved dye's deposition from the solution or the formation of dye agglomerates therein having a particle size of over 30 $\mu$m and advantageously over 15 $\mu$m.

37 Claims, 3 Drawing Sheets

PROCESS FOR DYEING A TEXTILE SUBSTRATE IN AT LEAST ONE SUPERCRITICAL FLUID

Figure 1:
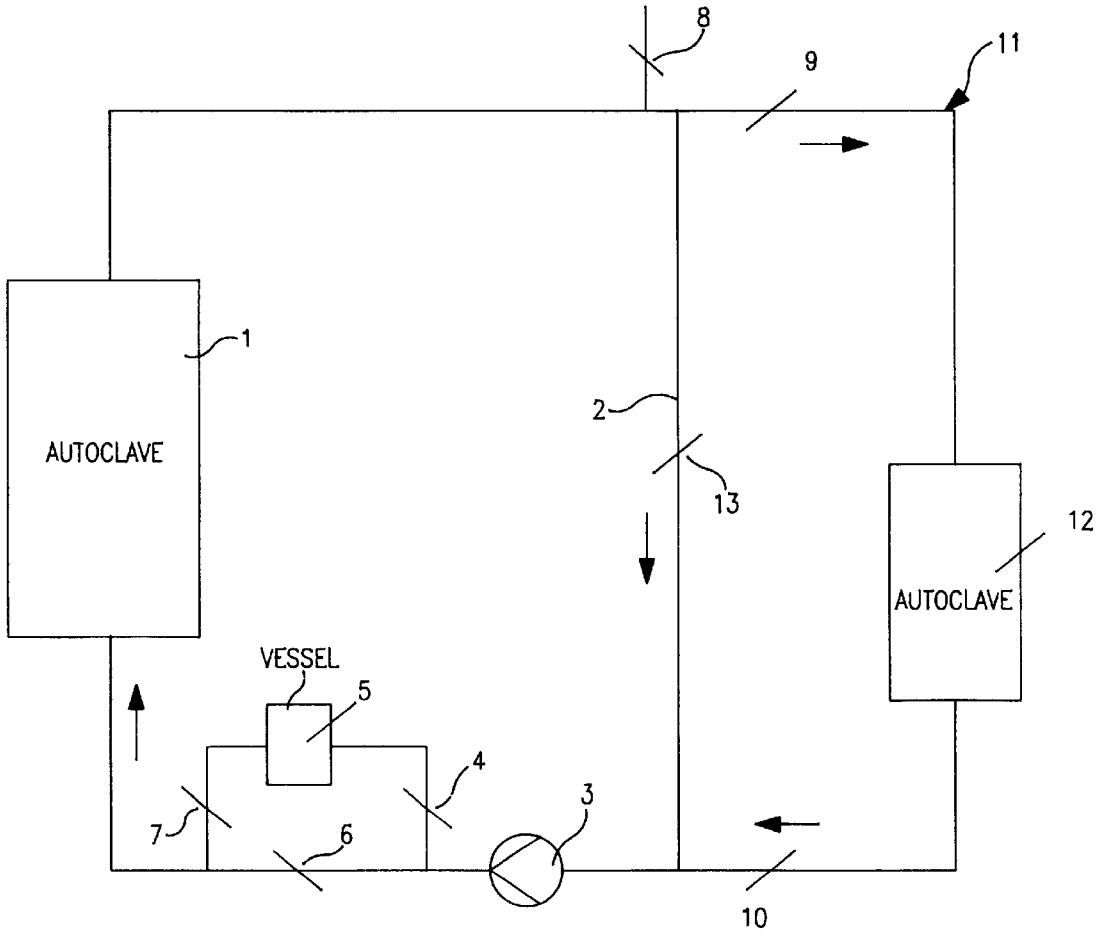

The present invention is directed to a method for the dyeing of a textile substrate in at least one supercritical fluid, preferably for the dyeing of yarn bobbins in supercritical carbon dioxide, with the characteristics of the generic part of patent claim 1.

In today's practice textile substrates are still dyed in aqueous systems, whereby the textile substrate to be correspondingly dyed is arranged within an autoclave where it is perfused, respectively superfused, with the aqueous liquor containing the at least one dye. Hereby this dyeing liquor is usually manufactured in that way that a concentrated aqueous dye solution, respectively dye dispersion, is firstly generated from the solid dye, whereby this concentrated dye solution, respectively dye dispersion, is subsequently diluted with the liquor existing in the autoclave. It is not possible to use a solid dye directly by avoiding the afore described concentrated dye solution, respectively dye dispersion, since this would inevitably cause the formation of color stains on the textile substrate as a consequence of non-solved or non-dispersed dyes.

A method for the dyeing of a textile substrate in at least one supercritical fluid with the characteristics of the generic part of patent claim 1 was recently developed. In this new dyeing method a supercritical fluid containing the at least one dye is used as dyeing liquor, whereby the textile substrate to be correspondingly dyed is then perfused, respectively superfused, with this supercritical dyeing liquor. In order to terminate the dyeing a pressure decrease or a temperature decrease is carried out, as this is described in detail in the DE-OS 39 06 724.

Further details about how the dye is introduced into the supercritical fluid are not described in the DE-OS 39 06 724.

In addition to the afore mentioned DE-OS 39 06 724, another publication in "Chemiefaser/Textilindustrie", 41./93. year, February 1991, with the title "Farbung von Polyester in überkritischem $CO_2$" is to be mentioned in which a laboratory device for the dyeing of a textile substrate in supercritical carbon dioxide is shown. Hereby this laboratory device comprises an autoclave for taking up the textile substrate to be dyed, whereby for the laboratory dyeing described therein the used solid dye is arranged at the bottom of the autoclave where it is continuously stirred which causes the fact that the dye is abundant in the autoclave, so that during the stirring a saturated fluid phase emerges.

The afore described known technique of introducing the at least one dye into the supercritical fluid might certainly be realisable in the laboratory standard, but it cannot be used in a large dimensioned technical use of the dyeing method in supercritical fluids described in this publication, since hereby the afore described color stains on the textile substrate known from the aqueous dyeing would also occur.

The present invention has the object to dispose a method for the dyeing of a textile substrate in at least one supercritical fluid of the indicated kind by which the textile substrate to be correspondingly dyed can be dyed in a particularly safe and trouble-free manner.

This object is realised according to the invention by a method with the characterising clauses of patent claim 1.

The inventive method for the dyeing of a textile substrate in at least one supercritical fluid, preferably for the dyeing of yarn bobbins in supercritical carbon dioxide, provides that the textile substrate is arranged within an autoclave where it is perfused, respectively superfused, with the supercritical fluid containing at least one dye. Hereby the supercritical fluid is brought into contact with the at least one dye as dye bulk, as dye melt, as dye solution and/or as dye dispersion under the formation of a stable solution of the dye, without causing the precipitation of the originally solved dye from the solution or without causing the formation of dye agglomerates in the solution, the dye agglomerates having a particle size of more than 30 $\mu$m, preferably of more than 15 $\mu$m. In other words, during the dyeing the dye used herefore is thus introduced as dye bulk, as dye melt, as dye solution and/or as dye dispersion into the supercritical fluid in such a way that it is guaranteed that the thus generated solution is so stable that dyes do not precipitate or dye agglomerates do not occur from the thus generated supercritical dye solution even in the subsequent high fluid turbulence, the dye or dye agglomerates having a particles size which is larger than 30 $\mu$m, preferably larger than 15 $\mu$m.

The terms solution, respectively solving, of the dye in supercritical fluid used in the present application do thus not only cover a monomolecular solution of the dye but also a multimolecular solution of the dye, as far as it is guaranteed that the dye agglomerates existing in the multimolecular solution have a particle size of 30 $\mu$m at a maximum or less, preferably of 15 $\mu$m or less.

The inventive method shows a number of advantages. It was surprisingly noted that by applying the inventive method bad dyeings, particularly the afore described color stains or non-homogeneous dyeings, could be avoided, which is referred to the fact that the supercritical dyeing liquor does contain exclusively monomolecularly solved dye and/or multimolecular dye agglomerates of the afore mentioned maximum particle size. This leads furthermore to the fact that the inventive method guarantees a high reproducibility relative to the color result meaning relative to the color depth as well as relative to the color shade. The color fastnesses generated by applying the inventive method, as particularly the moist resistance, as for example the sweat fastness, the friction resistance, the water and/or washing fastness, are impeccable. By using the inventive method in which the at least one dye is brought into contact with the supercritical fluid as dye bulk, as dye melt, as dye solution and/or as dye dispersion, it was moreover noted that an undesired dye residue did not remain at the end of the dyeing, which explains the already afore mentioned improved reproducibility of the dyeing. In the inventive method a baking of the dyes could not be observed. Such a baking of the dyes often occurs when the dye is arranged at the bottom of the autoclave, as this is often the case in the afore described known laboratory device.

In order to produce with the inventive method the solution of the dye in the supercritical fluid correspondingly used, as it is described above and required for the dyeing, in particularly rapid and reproducible manner, a first embodiment of the inventive method provides that hereby the dye bulk is formed as fluidized bed and/or as fixed bed being perfused and/or superfused by the supercritical fluid. If hereby the dye bulk is formed as fluidized bed the supercritical fluid is conducted through the dye bulk in such a way that the dye particles are swirled. Hereby it is possible, on one hand, to pack the dye particles so dense that at the beginning of the solving procedure, meaning at the beginning of the perfusion with the supercritical fluid correspondingly used, the dye particles are not yet swirled, so that they are then perfused, respectively superfused, as fixed bed by the supercritical fluid. With the proceeding of solving of the dye particles their mobility is increased, so that the dense dye particle packing is converted into a correspondingly loose packing, so that then the fluidized bed is formed. On the other hand it is also possible to use from the start such a packing density for the dye bulk that already at the beginning of the solving process the dye particles are swirled, whereby the actual solving process is accelerated and whereby the risk of a formation of large relatively hardly soluble dye agglomerates is avoided.

Another embodiment of the inventive method disposes that the dye bulk is provided with inert particles, particularly with glass balls and/or steel balls, so that in this embodiment of the inventive method the risk of a clumping of the dye to be correspondingly solved is avoided, because the dye particles to be solved do mainly not contact each other since they are located in the intermediate areas between the inert particles, which explains the already afore discussed reduction of the solving time of the dye to be solved. Furthermore, the flow ratios are thus made homogenous.

For the afore described embodiment of the inventive method the inert particles are preferably selected in that way that their geometrical form and/or their mass corresponds with the geometrical form and/or the mass of the correspondingly used dyes, so that it is guaranteed in this way that the fluid does not cause a dehomogenisation of dyes and of inert particles during its superfusion of the dye bulk containing inert particles.

Instead of the afore described adding of inert particles to the dye bulk or in addition to the afore described adding of inert particles to the dye bulk, such a dye bulk can be selected in the inventive method which consists of inert particles coated with the at least one dye or which at least comprises inert particles coated with the at least one dye. The advantage of such a dye bulk is that, on one hand, the clumping of the dye to be solved is effectively avoided and that, on the other hand, the solving process of the dye in the supercritical fluid is accelerated, since, by using inert particles coated with the dye, the surface of the dye to be solved is correspondingly enlarged.

A further acceleration of the solving process of the at least one dye in the correspondingly used supercritical fluid is obtained in another embodiment of the inventive method in that way that a granulate of said at least one dye is arranged in the afore described fluidized bed and/or fixed bed. Hereby it was observed that a particularly high acceleration of the solving process could be obtained when as granulate such a dye granulate is selected which has a medium particle diameter of between 0.5 mm and 5 mm, preferably between 1.5 mm and 3 mm.

If in the inventive method the dye bulk to be solved is formed as a fluidized bed, a particularly reproducible solving of the at least one dye, respectively the at least one dye granulate, can be caused within a very short time, so that the dye, respectively the dye granulate, is swirled in the fluidized bed at a minimum fluidisation speed of between 0.02 m/s and 0.12 m/s, preferably between 0.04 m/s and 0.06 m/s.

Another embodiment of the inventive method provides that for the solving of the at least one dye the dye bulk is formed as such a bulk which has an axial length being essentially larger than its radial dimension and that the supercritical fluid is mainly axially directed towards the bulk material. This causes an optimised exchange of substances and a reduction of the correspondingly required solving time.

For the afore described dye bulk which is preferably formed in a cylindrical or cylinder-like manner such a dye bulk is chosen that has an axial length that is two to ten times, preferably four to seven times, larger than its radial dimension.

Another embodiment of the inventive method provides that hereby the at least one dye is arranged within an inert material being provided with chambers and canals, whereby the chambers, respectively the canals, are arranged relatively to the flow direction of the supercritical fluid in that way that the chambers, respectively canals, are superfused by the supercritical fluid. In other words, this embodiment of the inventive method disposes the dye as fixed bed in the afore described specially formed inert material, so that during the superfusion of the chamber, respectively canals, the at least one dye located therein is then solved by the supercritical fluid.

In a further development of the above described embodiment of the inventive method the inert material is provided with honeycombed chambers, respectively canals, which makes it possible to arrange a possibly high concentration of the dye to be solved on a relatively small surface, without causing an undesired clumping or fusion of the dye to be solved.

Embodiments of the inventive method were precedently described according to which the at least one dye to be solved is formed as dye bulk. A fundamentally different option of the inventive method provides that hereby the at least one dye to be solved is injected into the supercritical fluid as dye melt, as dye solution and/or as dye dispersion, in order to manufacture the afore described solution of the at least one dye in the supercritical fluid, whereby this solution then certainly comprises the monomolecular and/or multimolecular dye but does not contain dye agglomerates with a medium particle size being larger than 30 $\mu$m, preferably larger than 15 $\mu$m. In other words, in the subsequently described developments of the inventive method a liquid dye and not a solid dye is brought into contact with the supercritical fluid to be correspondingly used. In order to obtain the liquid formulation of the dye to be correspondingly solved in the supercritical fluid several options exist.

A first option of the inventive method provides that the at least one dye is injected as dye melt into the supercritical fluid correspondingly used for the dyeing, whereby the dye is molten before in an inert gas, particularly in nitrogen or carbon dioxide. It was surprisingly noted that particularly dispersion dyes can be injected as a melt in a relatively homogenous and rapid manner into the corresponding supercritical fluid, without causing an undesired chemical modification of the dye, as for example a thermal degradation.

If in the afore described first option the at least one liquid dye existing as dye melt is injected into the correspondingly used supercritical fluid by means of a nozzle, such an operation then permits a particularly precise adding of the required dye amount, which again becomes apparent in the reproducibility of the dyeing generated according to the inventive method. The same is the case for the dye solution or the dye dispersion.

It is particularly advantageous if in the inventive method the at least one liquid dye existing as dye melt, as dye solution and/or as dye dispersion is introduced in doses into the correspondingly used supercritical fluid by means of a mixing area which is superfused by the supercritical fluid and the dye solution. Depending on the dye to be correspondingly solved and on the supercritical fluid used herefore, the dye amount to be solved can hereby adjusted to the solving capacity of the supercritical fluid for the used dye by means of an adjustable time/amount regulator, so that a solution of the dye emerges in the supercritical fluid within a very short time.

The second fundamental option, according to which not a solid dye but a liquid dye is solved in the supercritical fluid, provides that a dye solution and/or dye dispersion is injected into the supercritical fluid.

If in this embodiment of the inventive method water-soluble dyes are used, it is advisable to inject an aqueous dye solution into the supercritical fluid. In the case of water-insoluble dyes acetone, chloroform, dimethylformamid, polymer ethylenglycol, preferably with a molecular weight of between 200 and 1.000, polymer propylenglycol, preferably with a molecular weight of between 150 and 1.200, an oil and/or a low alcohol, particularly ethanol, propanol-2, propanol-1, butanol-1 and/or butanol-2, is used as solvent, respectively as dispersion agent, for the producing of the dye solution, respectively the dye dispersion, whereby the afore mentioned organic solutions are also particularly suitable for dispersion dyes.

If, in the afore described second option of the inventive method, the at least one dye to be correspondingly used does not sufficiently solve in a corresponding non-toxic solvent or if herefore large solvent amounts are necessary which modify the properties of the supercritical fluid in an undesired way, particularly the solving capacity for the correspondingly used dye, when added to the supercritical fluid, a development of the afore described second option provides that, in addition to the dye solution or instead of the dye solution, a dye dispersion, preferably an aqueous dye dispersion, is injected into the supercritical fluid.

According to the afore described inventive method each textile substrate can be dyed in each form, whereby, however, the initially mentioned advantages of the inventive method become more evident when sewing yarns consisting of polyester fibres which are formed particularly as a crosswound package (X-bobbin) are dyed according to the inventive method. Particularly when the afore mentioned sewing yarn consisting of polyester fibers is formed as a crosswound package and when furthermore the supercritical carbon dioxide is selected as supercritical fluid and when a dispersion dye is chosen as at least one dye, homogeneously dyed resistant dyeings can be reproducibly obtained within a very short time without leading to undesired trouble.

In order to guarantee in the inventive method that the textile substrate to be dyed is brought into contact with only one solution of the at least one dye in the correspondingly used supercritical fluid, whereby this solution then comprises dye agglomerates with a maximum particle size of less than 30 $\mu$m, preferably of less than 15 $\mu$m, a further development of the inventive method provides that the supercritical fluid containing the solved dye is filtered through a filter before this supercritical fluid containing the dye is then brought into contact with the textile substrate to be dyed. Herefore a filter and particularly a sintered metal plate are selected which have pores with a pore size of smaller than or equal to 30 $\mu$m, preferably smaller than or equal to 15 $\mu$m, so that by means of this filter, respectively this sintered metal plate, such dye agglomerates can be retained that are larger than 30 $\mu$m, preferably larger than 15 $\mu$m.

Advantageous developments of the inventive method are indicated in the subclaims.

Figure 2:
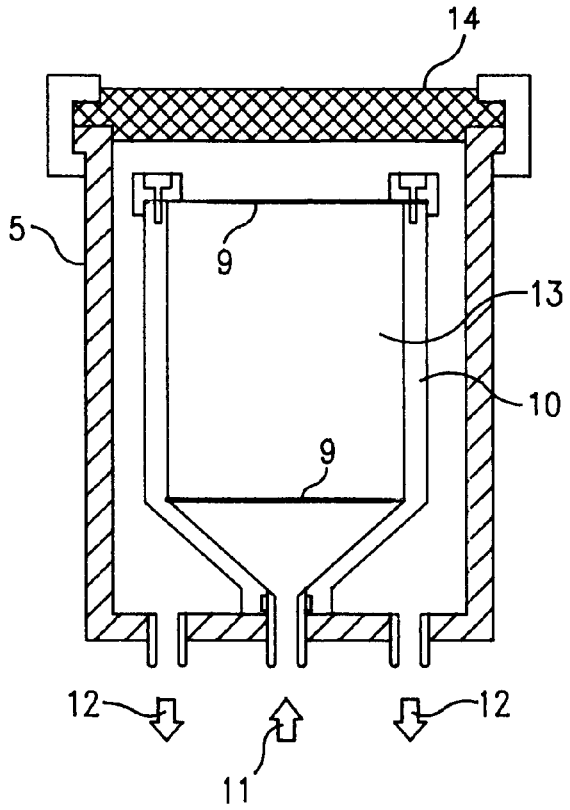
Figure 3:
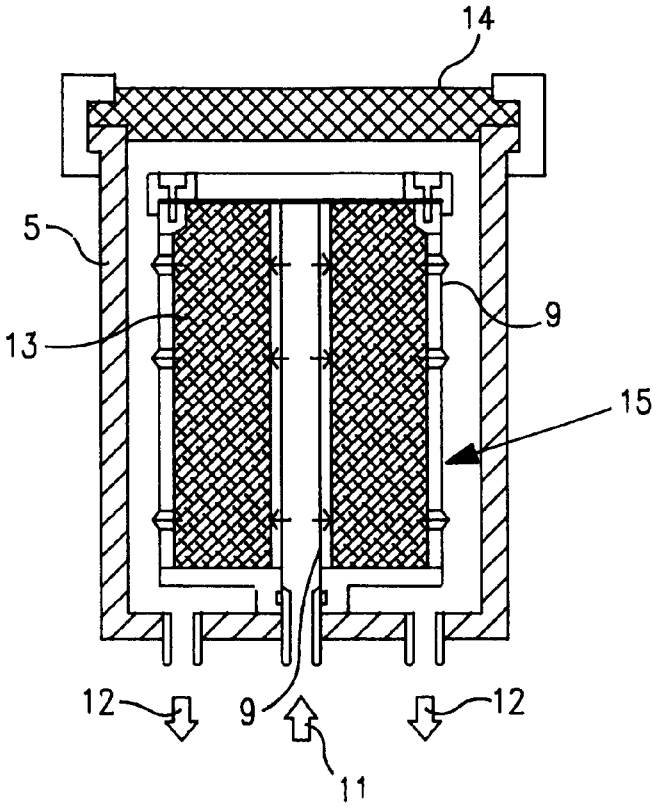

In the following examples the inventive method is subsequently described in detail in connection with the drawing. The following figures show:

FIG. 1 a schematical flow chart of the device used for all dyeings;

FIG. 2 a schematical sectional view of a first embodiment of the dye preparing vessel used for the inventive method; and FIG. 3 a schematical sectional view of a second embodiment of the dye preparing vessel used for the inventive method.

Figure 4:
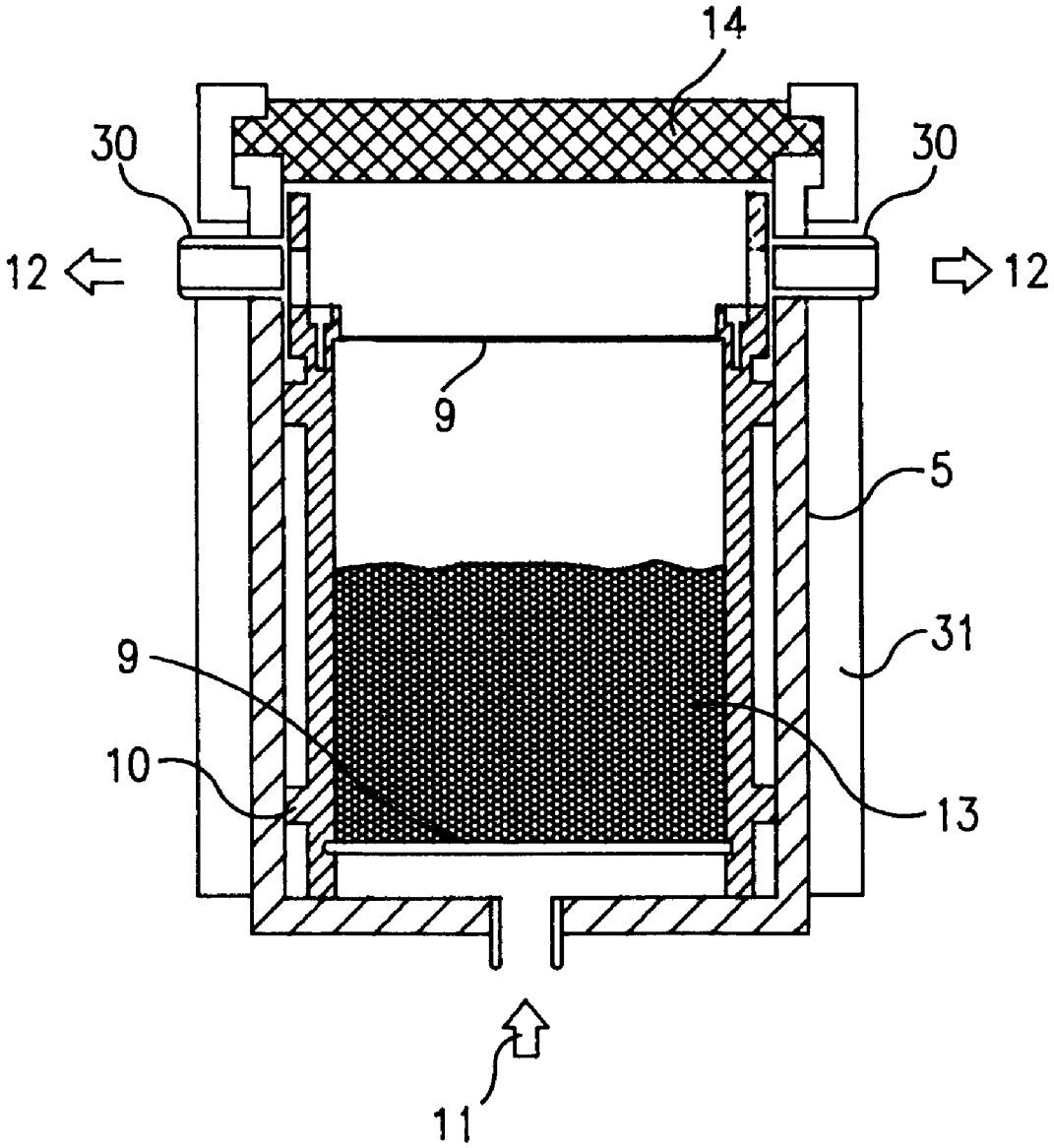

FIG. 4 a schematical sectional view of a third embodiment of the dye preparing vessel used for the inventive method.

In FIG. 1 the device used for all the subsequently described dyeing tests is schematically shown, whereby the dyeing device comprises a dyeing autoclave 1 in which a column consisting of four crosswound packages (X-bobbins) of a sewing yarn is arranged for the dyeing.

The dyeing autoclave 1 comprises a first circulation system, whereby the first circulation system comprises a corresponding tube conduct system 2. A circulation pump 3 is located within the tube conduct system 2 of the first circulation system.

A dye preparing vessel 5 the embodiments of which are subsequently described in connection with the FIGS. 1 to 4 is arranged within a bypass of the tube conduct system 2.

Furthermore, the tube conduct system 2 comprises a feeding not being shown for carbon dioxide as well as a heat exchanger (also not shown).

The device schematically shown in FIG. 1 comprises a second circulation system designated with 11 in addition to the first circulation system. Hereby this second circulation system 11 being also named adsorption circulation comprises three valves 9, 10 and 13 as well as one autoclave 12, whereby the autoclave 12 is filled with a subsequently described sorbent.

The afore described device shown in FIG. 1 operates in the following way:

First of all the column of the four sewing yarn X-bobbins is arranged within the autoclave 1. After closing the autoclave the corresponding tube conduct system 2 of the first circulation system and the autoclave 1 itself are filled with supercritical carbon dioxide by means of the feeding not shown and by means of a pressure increasing pump also not shown. Hereafter the circulation pump 3 is put into operation which leads to the fact that the supercritical carbon dioxide flows in the direction of the arrow through the tube conduct system 2 and the autoclave 1. In this moment the valves 9 and 10 are closed whereas the valve 13 is opened.

After obtaining the subsequently indicated conditions of the executed three dyeing tests being subsequently described the valves 4 and 7 of the bypass are opened, so that the supercritical carbon dioxide flows through the dye preparing vessel 5 where it solves the subsequently mentioned marine dyestuff. In this moment the valve 6 is closed.

After the expiration of the dyeing time of 35 minutes the valves 9 and 10 shown in FIG. 1 are opened without modifying the pressure and the temperature whereas the valve 13 is closed. This causes a superfusion of the second circulation system 11 and the autoclave 12 arranged therein in the direction of the arrow.

After a retaining time of 5 minutes the device is released by means of the opened valve 8, as this will be subsequently described.

The autoclave 12 is filled with a silica gel, type trysil. This silica gel has hereby a particle size of between 2 mm and 8 mm, a density of 2.200 kg/m$^3$, a bulk density of 550 kg/m$^3$, a porosity of 0.55, an inner surface of ca. 450 m$^2$/g, a pore volume of 0.4 cm$^3$/g, a medium pore diameter of between 4 nm and 10 nm and a tortuosity factor of 5.0.

In order to avoid undesired pressure fluctuations and/or temperature fluctuations during the connecting of the first circulation system with the second circulation system, the second circulation system was filled before with supercritical carbon dioxide at a pressure of 250 bar and at a temperature of 130° C.

The first embodiment of the dye preparing vessel 5 shown in FIG. 2 is formed as fluidized bed-dye preparing vessel 5, whereby this dye preparing vessel comprises an inner cylindrical vessel 10 which is closed at its top and bottom side with a sintered metal plate 9, whereby these sintered metal plates 9 are formed as filters having a pore size of 30 $\mu$m.

For the subsequently described dyeing test 2 the dispersion dyestuff 13 (not shown) is arranged within the vessel 10 in that way that this dispersion dyestuff 13 is swirled by means of the supercritical fluid (flow direction 11) flowing into the dye preparing vessel 5. The supercritical fluid containing the solved dye then leaves the dye preparing vessel 5 in the direction of the arrow 12.

The second embodiment of the dye preparing vessel 5 shown in FIG. 3 comprises a cylindrical vessel 15, whereby the cylindrical vessel 15 is arranged distantly from the inner walling of the dye preparing vessel 5. Hereby the cylindrical vessel 15 takes up the dyestuff 13 to be correspondingly dyed in the form of a fixed bed.

A supercritical carbon dioxide flows into the cylindrical vessel 15 in the direction of the arrow 11 by operating the valves 4, 6 and 7 (FIG. 1), whereby the wallings 9 of the cylindrical vessel 15 are formed as sintered metal surfaces and thus are effective as filter, so that dye particles with a medium particle diameter of more than 30 $\mu$m cannot pass the wallings 9 of the cylindrical vessel 15.

The supercritical carbon dioxide flowing into the cylindrical vessel 15 superfuses the dyestuff 13 being arranged as fixed bed within the cylindrical vessel 15, so that the supercritical fluid containing the solved dyestuff leaves the dye preparing vessel 5 in the direction of the arrow 12.

The third embodiment of the dye preparing vessel 5 shown in FIG. 4 is formed as fluidized bed-dye preparing vessel 5, whereby this dye preparing vessel comprises an inner cylindrical vessel 10 which is closed at its top and bottom side with a sintered metal plate 9, whereby these sintered metal plates 9 are formed as filters and have a pore size of 30 $\mu$m.

The dispersion dyestuff 13 is arranged within the vessel 10 in that way that this dispersion dyestuff 13 is swirled by means of the supercritical fluid (flow direction 11) flowing into the dye preparing vessel 5. The supercritical fluid containing the solved dyestuff leaves the dye preparing vessel 5 in the direction of the arrow 12. In order to make this possible, the dye preparing vessel 5 shown in FIG. 4 comprises four connecting pieces 30 being homogeneously spread over the circumference of the dye preparing vessel. The ratio of the axial length of the vessel 10 to its diameter is 1:2.5 in the embodiment shown in FIG. 4. Moreover, the dye preparing vessel 5 shown in FIG. 4 comprises a jacket heating 31.

All dye preparing vessels 5 shown in the FIG. 2 to 4 are provided with a fluid-tight closable cover 14 (fast locker).

The dye preparing vessel 5 shown in FIG. 2 is used in the dyeing test 2 described in the following and the dye preparing vessel 5 shown in FIG. 3 is used in the subsequently described dyeing test 3.

The subsequently described dyeing tests 1 to 3 were carried out in the same device, as this is shown in FIG. 1, under the same conditions, whereby only the manner of the solving process of the dye used herefore was different.

In each of the three dyeing tests a column consisting of four sewing yarn X-bobbins (total weight 9.8 kg) was dyed, whereby the sewing yarn consisted of polyester (polyethylenterephthalate). Herefore the following dye was used in each dyeing test:

3% by weight of a marine-blue dispersion dye.

The used marine-blue dispersion dye was a pure dye, meaning that it did not contain any floating agents or other additives.

The conditions for all the dyeing tests were the following ones:

Supercritical fluid: carbon dioxide

Liquor ratio: 1:8

Temperature: 130° C.

Pressure: 250 bar

Dyeing time: 35 minutes

At the end of all dyeings, meaning that after the supercritical carbon dioxide containing the non-absorbed dye residue was treated for 5 minutes in the second circulation system 11, the pressure was reduced from 250 bar to 80 bar within ten minutes, whereby after obtaining this final pressure of 80 bar a continuous pressure decrease down to normal pressure occurred within four minutes.

DYEING TEST 1

At the beginning of the dyeing the dye was arranged in a cotton bag at the bottom side of the dyeing autoclave, so that in this dyeing test the dye could not leave the dyeing autoclave in an undesired way.

DYEING TEST 2

After obtaining the afore mentioned dyeing temperature and the afore indicated dyeing pressure, the valves 4, 6 and 7 shown in FIG. 1 were adjusted in that way that, during the whole dyeing time of 35 minutes, a partial flow of the supercritical carbon dioxide was entered into the dye preparing vessel 5 in the direction of the arrow 11 and the supercritical fluid containing the dye was fed back into the dyeing circulation circuit 2 in the direction of the arrow 12. Hereby a fluidized bed was formed by the supercritical carbon dioxide in the dye preparing vessel 5 (FIG. 2), whereby the supercritical carbon dioxide was entered at a minimum fluidisation speed of 0.06 m/s in the direction of the arrow 11.

DYEING TEST 3

For this dyeing test the whole dye was arranged within the vessel 15 shown in FIG. 3, whereby the other conditions correspond with the conditions as they are precedently described for the dyeing test 2.

The visual analysis of the dyeings resulted in the fact that all X-bobbins which were dyed according to the dyeing test 1 were not homogenous and partially showed areas which have not been dyed. Moreover, a lot of dye precipitations on the material could be observed in the material dyed in that way.

The bobbins dyed according to the dyeing tests 2 and 3 were all dyed homogeneously, whereby in respect to the color yield (color shade and color depth) no differences could be noted over the whole axial length and the radial dimensions of the dyed bobbins.

Furthermore it is to be noted that the dyeing generated according to the dyeing test 1 was essentially lighter than the dyeings realised according to the dyeing tests 2 and 3.

The measured moist fastnesses (friction resistance, washing fastness, water fastness and sweat fastness) of the dyeing done by the dyeing test 1 laid between 1 and 2 and were thus not acceptable, whereas the mentioned fastnesses of the dyeings done by the dyeing tests 2 and 3 laid between 3 and 4 and are thus to be classified as very good results.

In the dyeing test 1 a dye residue remained which was fused together and which came to 30% by weight of the originally used dye amount.

We claim:

1. A method for the dyeing of a textile substrate, comprising:

arranging at least one cross-wound package of polyester yarn within an autoclave;

preparing a dye solution by contact of a supercritical fluid with a dyestuff including at least one dye, said dye solution being substantially free of dye agglomerates having a particle size in excess of about 30 μm; and exposing said cross wound package to said dye solution moving relative thereto.

2. The method according to claim 1, wherein said dye solution is substantially free of dye agglomerates having a particle size in excess of about 15 μm.

3. The method according to claim 1, wherein the dyestuff is provided in a form of a fluidized bed.

4. The method according to claim 1, wherein the dyestuff is provided in a form of a fixed bed.

5. The method according to claim 3, wherein the dyestuff further comprises inert particles.

6. The method according to claim 5, wherein the inert particles are coated with the at least one dye.

7. The method according to claim 3, wherein a granulate of the at least one dye is located in the fluidized bed.

8. The method according to claim 5, wherein a granulate of the at least one dye is located in the fixed bed.

9. The method according to claim according to claim 7, wherein said granulate has a medium particle diameter of between about 0.5 mm and about 5 mm.

10. The method according to claim according to claim 9, wherein said medium particle diameter is between about 1.5 mm and about 3 mm.

11. The method according to claim according to claim 8, wherein said granulate has a medium particle diameter of between about 0.5 mm and about 5 mm.

12. The method according to claim according to claim 11, wherein said medium particle diameter is between about 1.5 mm and about 3 mm.

13. The method according to claim 3, wherein the dyestuff is swirled in the fluidized bed at a minimum fluidization speed of between about 0.02 m/s and about 0.12 m/s.

14. The method according to claim 13, wherein said minimum fluidization speed is between about 0.04 m/s and about 0.06 m/s.

15. The method according to claim 11, wherein:

the dyestuff is provided as bulk material having an axial length larger than a radial dimension thereof; and the supercritical fluid is mainly led through the bulk material axially.

16. The method according to claim 15, wherein said axial length is about two to about ten times larger than the radial dimension thereof.

17. The method according to claim 16, wherein said axial length is about four to about seven times larger than said radial dimension.

18. The method according to claim 1, wherein:

the at least one dye is arranged within an inert material being provided with one of chambers and canals;

the at least one dye is fed into said one of chambers and canals; and the inert material is arranged relatively to the flow direction to conduct the supercritical fluid therethrough.

19. The method according to claim 18 wherein the inert material comprises a honeycombed internal structure.

20. The method according to claim 1, wherein:

said dye is a liquid dye; and said step of preparing includes injecting the liquid dye into the supercritical fluid.

21. The method according to claim 20 wherein the liquid dye is in the form of a dye melt.

22. The method according to claim 20, wherein the liquid dye is in the form of a dye solution.

23. The method according to claim 20, wherein the liquid dye is in the form of a dye dispersion.

24. The method according to claim 20 wherein:

the liquid dye is a dye melt; and the method further comprises melting said dye melt in an inert gas prior to said step of injecting.

25. The method according to claim 20, wherein the at least one dye is injected into the supercritical fluid by means of a nozzle.

26. The method according to claim 20, wherein said step of injecting includes introducing the liquid dye in doses into the supercritical fluid in a mixing area suffused by the supercritical fluid.

27. The method according to claim 20, wherein said liquid dye includes a liquid component selected from the group consisting of acetone, chloroform, dimethylformamid, ethylenglycol, propylenglycol, an oil and a low alcohol.

28. The method according to claim 27, wherein said low alcohol is selected from the group consisting of ethanol, propanol-2, propanol-1, butanol-I, butanol-2 and mixtures thereof.

29. The method according to claim 27, wherein a dye dispersion is injected into the supercritical fluid.

30. The method according to claim 29, wherein said dye dispersion is an aqueous dye dispersion.

31. The method according to claim 1, wherein said yarn is a sewing yarn consisting of polyester fibers.

32. The method according to claim 1, wherein:

said supercritical fluid is carbon dioxide; and said at least one dye is a dispersion dye.

33. The method according to claim 1, wherein said step of preparing includes filtering the supercritical fluid containing the dye through a filter having a pore size which does not exceed about 30 μm.

34. The method according to claim 1, wherein said pore size does not exceed about 15 μm.

35. The method according to claim 1, wherein said dye solution perfuses said textile substrate in said step of exposing.

36. The method according to claim 1, wherein said dye solution flows through said textile substrate in said step of exposing.

37. A method for the dyeing of a textile substrate, comprising:

arranging a textile substrate within an autoclave;

preparing a dye solution by contact of a supercritical fluid with a dyestuff including at least one dye contained in a vessel;

removing said dye solution from said vessel in a manner restricting a passage of dye agglomerates having a particle size in excess of about 30 μm; and exposing said textile substrate to said dye solution.

* * * * *